US011530588B1

(12) United States Patent
Schultz et al.

(10) Patent No.: US 11,530,588 B1
(45) **Date of Patent: *Dec. 20, 2022**

(54) METHODS AND DEVICES FOR CASING AND CEMENTING WELLBORES

(71) Applicant: Thru Tubing Solutions, Inc., Oklahoma City, OK (US)

(72) Inventors: Roger L. Schultz, Ninnekah, OK (US); Timothy W. Manke, Blanchard, OK (US); Andrew M. Ferguson, Oklahoma City, OK (US)

(73) Assignee: Thru Tubing Solutions, Inc., Oklahoma City, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/993,489

(22) Filed: Aug. 14, 2020

Related U.S. Application Data

(63) Continuation of application No. 16/056,743, filed on Aug. 7, 2018, now Pat. No. 10,781,654.

(51) Int. Cl.

| | |
|---|---|
| ***E21B 23/08*** | (2006.01) |
| ***E21B 23/10*** | (2006.01) |
| ***E21B 33/126*** | (2006.01) |
| ***E21B 37/10*** | (2006.01) |
| ***E21B 31/00*** | (2006.01) |
| ***E21B 33/14*** | (2006.01) |

(52) U.S. Cl.
CPC ..... *E21B 31/005* (2013.01); *E21B 33/14* (2013.01); *E21B 37/10* (2013.01); *E21B 33/126* (2013.01)

(58) Field of Classification Search
CPC ..... E21B 23/08; E21B 23/10; E21B 33/1204; E21B 33/126; E21B 31/005; E21B 37/10
See application file for complete search history.

(56) References Cited

U.S. PATENT DOCUMENTS

| | | | | |
|---|---|---|---|---|
| 8,424,605 B1 * | 4/2013 | Schultz | ..... | E21B 28/00 166/286 |
| 2009/0008088 A1 * | 1/2009 | Schultz | ..... | E21B 36/02 166/249 |

* cited by examiner

*Primary Examiner* — Cathleen R Hutchins
(74) *Attorney, Agent, or Firm* — Mary M. Lee

(57) ABSTRACT

A casing string is augmented with one or more variable flow resistance devices or "vibrating tools" to facilitate advancement of the casing and distribution of the cement in the annulus once the casing is properly positioned. Vibrating tools in the form of plugs can be pumped down and landed inside the casing string. The method includes vibrating the casing string while advancing the casing down the wellbore or while the cement is pumped into the annulus, or both. After the cementing operation is completed, the devices may be drilled out or retrieved with fishing tools to reopen the casing string for further operations. One or more wipers may be provided on the plugs, but the section housing the flow path may be free of wipers to allow the size and flow capacity of the flow path to be optimized.

35 Claims, 10 Drawing Sheets

METHODS AND DEVICES FOR CASING AND CEMENTING WELLBORES

FIELD OF THE INVENTION

The present invention relates generally to casing and cementing wellbores.

DETAILED DESCRIPTION OF THE PREFERRED EMBODIMENT(S)

Once a section of wellbore is drilled, it must be cased. This involves positioning the casing in the target location and then filling annular space between the casing and the wall of the wellbore with cement. In many cases, the wellbore is cased in sections, each subsequent section having a slightly smaller diameter casing than the previous section, making a so-called "tapered" casing string. In deep wells, and especially in horizontal well operations, the frictional forces between the casing string and the borehole wall make advancing the casing string very difficult. These frictional forces are exacerbated by deviations in the wellbore, hydraulic loading against the wellbore, and, especially in horizontal wells, gravity acting on the drill string.

The present invention is directed to methods and devices for finishing a wellbore, that is, for positioning the casing in the wellbore or for cementing the emplaced casing or both.

These methods and devices employ a vibrating tool in the casing string to facilitate advancement of the string. As used herein, "vibrating tool" refers to a tool comprising a variable flow resistance device, that is, a force generating tool that repetitively interrupts fluid flow to generate cyclic hydraulic loading on the casing string, thereby causing repeated extension and contraction of the casing string. This vibratory motion breaks the static friction reducing the drag force on the casing string. The pulsating motion of the casing string caused by the vibrating tool helps advance the casing string along the borehole. Additionally, during the cementing operation, the pulsing and vibration of the casing string enhances the distribution of the cement as it is pumped into the annulus around the casing. Advantageously, where a drillable vibrating tool is used, the tools can be drilled out once the cementing operation is completed.

Figure 1:
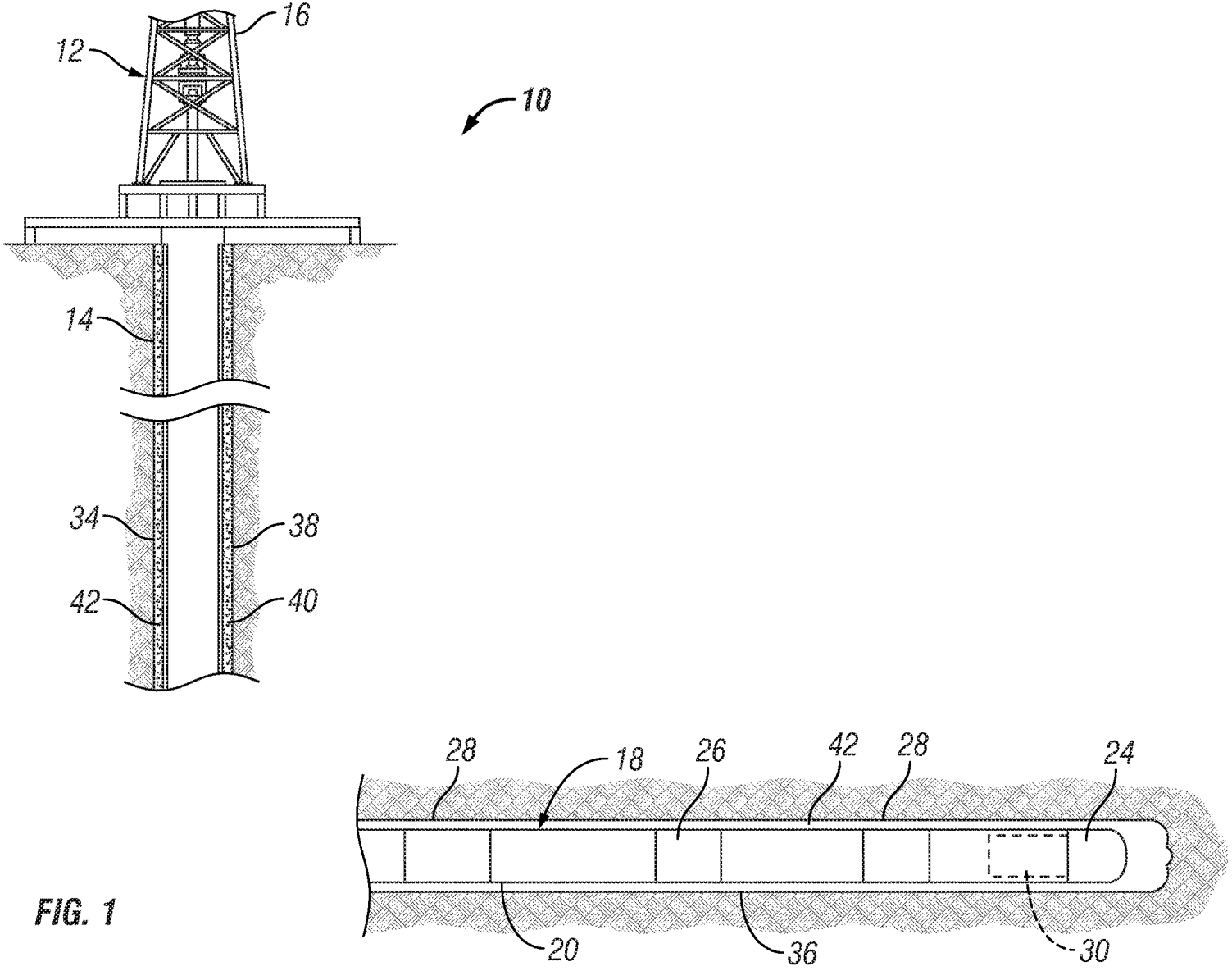
FIG. 1 is a diagrammatic illustration of a casing string deployment system comprising a plurality of variable flow resistance devices in accordance with the present invention.

Turning now to the drawings in general and to FIG. 1 in particular, there is shown therein an oil well designated generally by the reference number 10. A typical derrick-type casing deployment system 12 is shown at the wellhead for casing the well as the wellbore 14 is extended. However, as used herein, "casing deployment system" means any system or structure for supporting and advancing the casing string for lining the wellbore 14. Typically, the exemplary casing deployment system 12 includes a derrick 16 and the casing string assembly 18.

The casing string assembly 18 includes tools, such as float shoes and float collars, that are connected in the casing string 20. The number, type, and location of such tools in the casing string assembly 18 may vary. In the casing string assembly 18, the casing string 20 is equipped with a float shoe 24, a float collar 26, and two vibrating collars both designated at 28. Additionally, the casing string assembly 18 includes a vibrating plug 30. As will be described in detail hereafter, the vibrating tool of the present invention may take the form of a collar, plug, or shoe, but usually will be combined with one or more conventional float shoes or collars. It will be understood that although the casing string 18 includes all these types of devices, in practice not all these tools would be used together as shown. For example, the operator may run the plug after drilling out one or more of the collars.

The wellbore 14 comprises a vertical section 34 and a generally horizontal section 36. The vertical section is lined with casing 38. The casing 38 is secured by cement 40 in the annulus 42 between the walls of the wellbore 14 and the casing. The casing string assembly 18 is shown positioned in the still uncased horizontal section 36.

Figure 2:
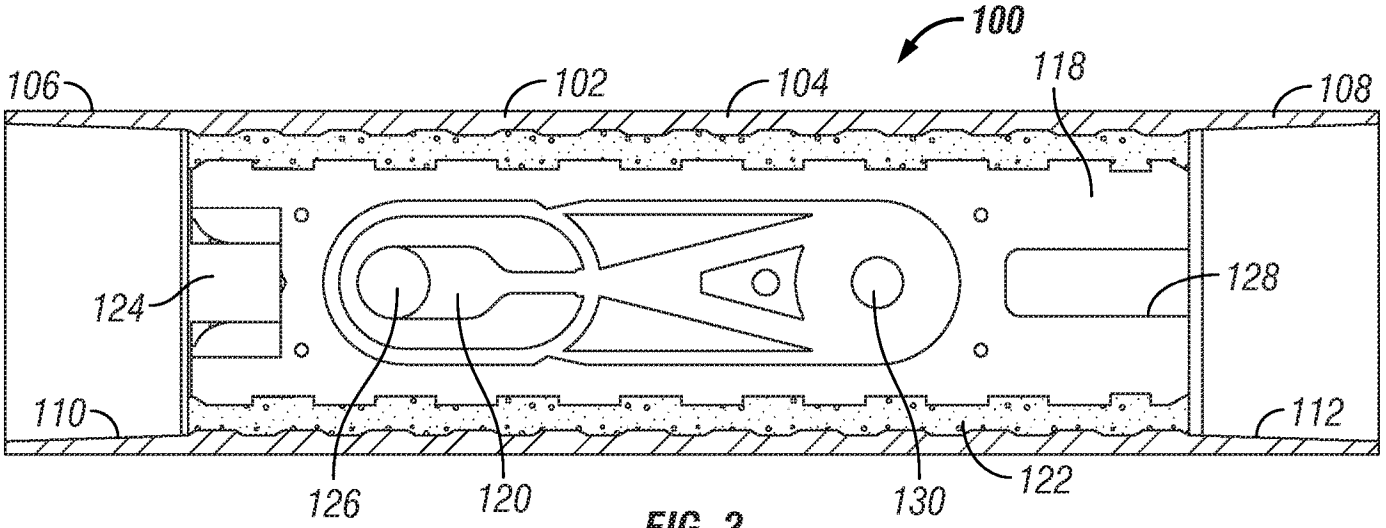
FIG. 2 is a longitudinal sectional view of a preferred casing collar comprising a variable flow resistance device in accordance with a preferred embodiment of the present invention.

FIG. 2 shows a casing collar embodiment of the preferred vibrating tool of the present invention and is designated generally at 100. The vibrating tool 100 comprises a housing 102 with a body section 104 having uphole and downhole ends 106 and 108, each adapted for connection to the casing string 20 or to another tool in the casing string assembly 18. In most instances, the ends 106 and 108 will be threaded at 110 and 112. The housing 102 preferably is made from tubular steel.

An insert 118 is secured inside the body section 104 of the housing 102. The insert 118 defines a flow path 120 for generating pulsations in the well fluids, as described in more detail hereafter. The term "well fluids" refers broadly to any fluids utilized in a wellbore. As used herein, the term "wellbore" refers to the subterranean well opening, including cased and uncased.

In most instances, it will be desirable to form the insert 118, as well as the housing 102, of a drillable material. While the housing 102 may be made of tubular steel, it is advantageous to make the insert 118 out of rubber, brass, aluminum, composite, or plastic. In one preferred embodiment, the insert 118 is molded of rubber. In particular, the insert 118 preferably is molded in two halves forming opposing inner faces, only one of which is shown herein. The flow path 120 may be formed as a patterned recess in each of the faces, which together form a complete flow path. The insert 118 may be permanently secured inside the body section 104 using a high strength cement 122, such as Portland cement, or some other drillable adhesive.

The insert 118 includes an insert inlet 124 continuous with the uphole end 106 of the tool 100. The insert inlet 124 directs fluid to enter flow path inlet 126. The insert 118 includes an insert outlet 128 that receives fluid leaving the flow path 120 through the flow path outlet 130. In this way, fluid flowing through the casing string assembly is forced through the flow path 118.

Figure 3:
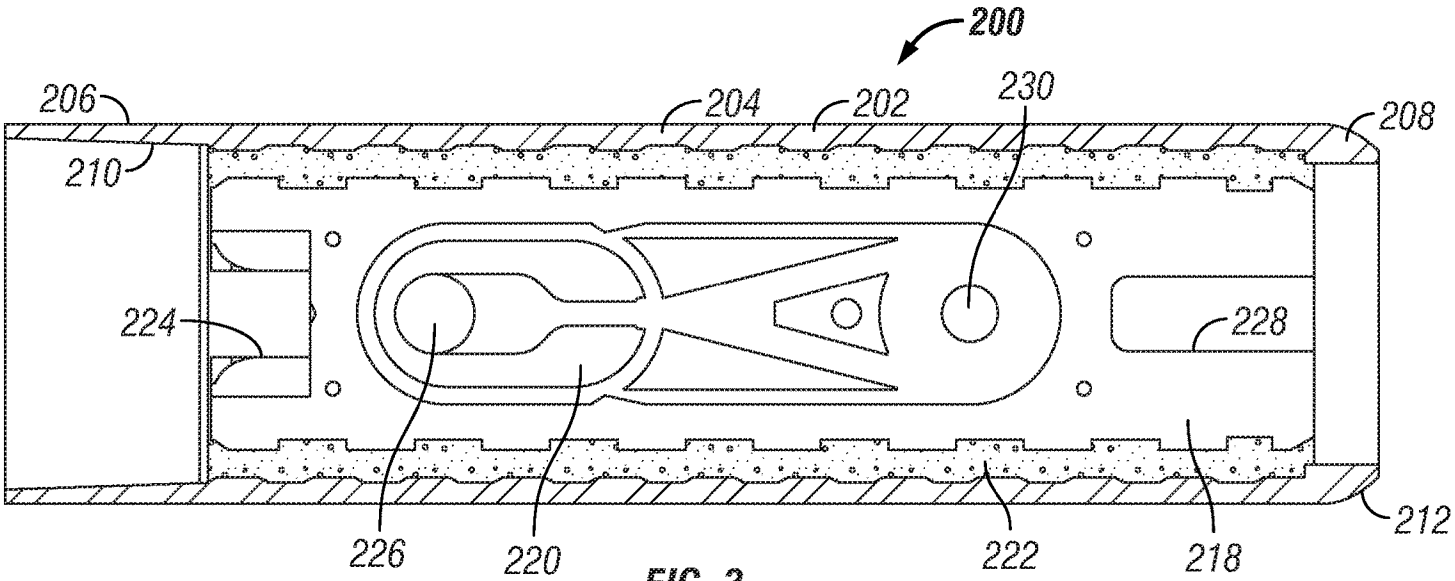
FIG. 3 is a longitudinal sectional view of a preferred casing shoe comprising a variable flow resistance device in accordance with a preferred embodiment of the present invention.

FIG. 3 shows a casing shoe embodiment of the preferred vibrating tool of the present invention and is designated generally at 200. The vibrating tool 200 comprises a housing 202 with a body section 204 having uphole and downhole ends 206 and 208. The uphole end 206 is adapted for connection to the casing string 20 or to another tool in the casing string assembly 18. In most instances, the uphole end 206 will be threaded at 210. The downhole end 208 is open and the edge 212 surrounding the open end beveled or radiused or otherwise blunted in a known manner to facilitate advancement of the leading end of the casing string assembly 18.

The tool 200 includes an insert 218 secured inside the body section 204 of the housing 202 using cement 222. The insert 218 defines a flow path 220 similar to the flow path 120 of the tool 100 in FIG. 2, and includes an insert inlet 224 and insert outlet 228 continuous with a flow path inlet 226 and flow path outlet 230, as in the previously described collar embodiment.

Figure 4:
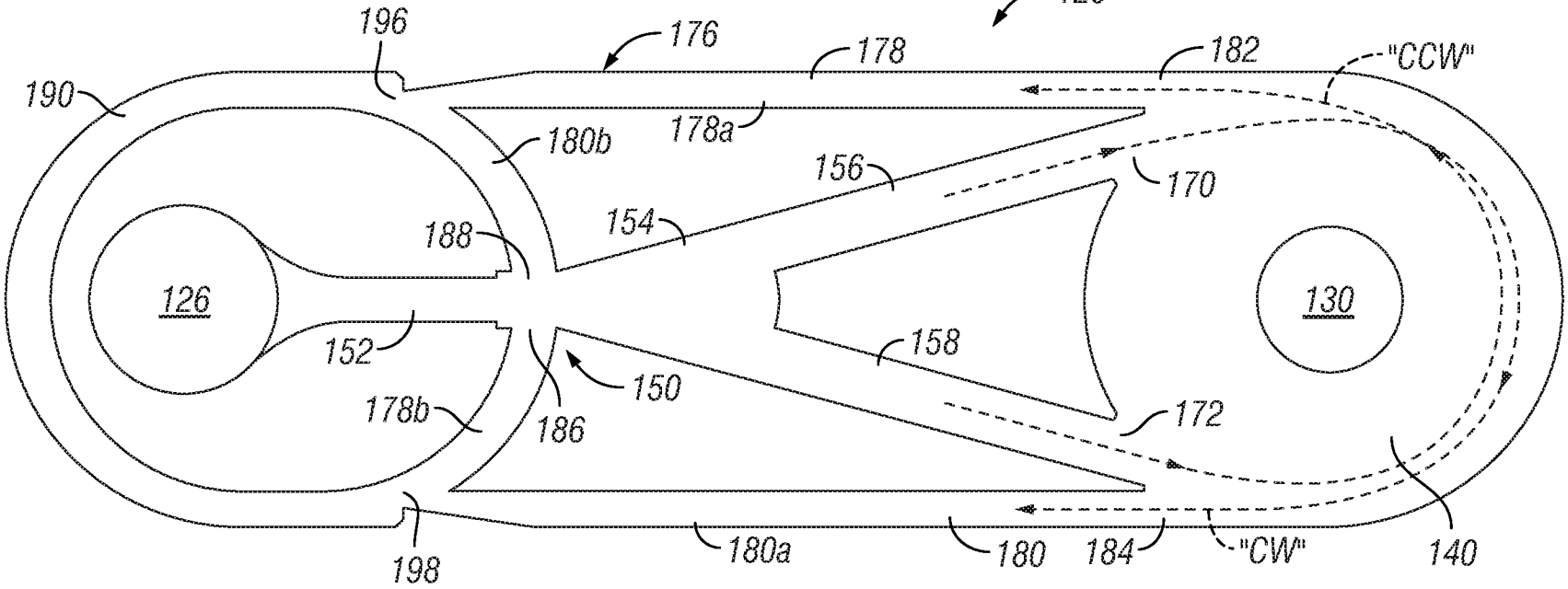
FIG. 4 is an illustration of the flow path of a preferred variable flow resistance device for use in the methods and devices of the present invention.

FIG. 4 shows the preferred flow path for use in the vibrating tools of the present invention. Since the flow paths 120 and 220 are similar, only the flow path 120 will be described in detail. Fluid enters the flow path 120 through the flow path inlet 126 and exits through the flow path outlet 130, as indicated previously. Fluid is directed from the inlet 126 to a vortex chamber 140 that is continuous with the outlet 130. In a known manner, fluid directed into the vortex chamber 140 tangentially will gradually form a vortex, either clockwise or counter-clockwise. As the vortex decays, the fluid exits the outlet 130.

A switch of some sort is used to reverse the direction of the vortex flow, and the vortex builds and decays again. As this process of building and decaying vortices repeats, and assuming a constant flow rate, the resistance to flow through flow path varies and a fluctuating backpressure is created above the device.

In the preferred embodiment, the switch, designated generally at 150, takes the form of a Y-shaped bi-stable fluidic switch. To that end, the flow path 120 includes a nozzle 152 that directs fluid from the inlet 126 into a jet chamber 154. The jet chamber 154 expands and then divides into two diverging input channels, the first input channel 156 and the second input channel 158, which are the legs of the Y.

According to normal fluid dynamics, and specifically the "Coandă effect," the fluid stream exiting the nozzle 152 will tend to adhere to or follow one or the other of the outer walls of the chamber so the majority of the fluid passes into one or the other of the input channels 156 and 158. The flow will continue in this path until acted upon in some manner to shift to the other side of the jet chamber 154.

The ends of the input channels 156 and 158 connect to first and second inlet openings 170 and 172 in the periphery of the vortex chamber 140. The first and second inlet openings 170 and 172 are positioned to direct fluid in opposite, tangential paths into the vortex chamber. In this way, fluid entering the first inlet opening 170 produces a clockwise vortex indicated by the dashed line at "CW" in FIG. 4. Similarly, once shifted, fluid entering the second inlet opening 172 produces a counter-clockwise vortex indicated by the dotted line at "CCW."

As seen in FIG. 4, each of the first and second input channels 170 and 172 defines a flow path straight from the jet chamber 154 to the continuous openings 170 and 172 in the vortex chamber 140. This straight path enhances the efficiency of flow into the vortex chamber 140, as no momentum change in the fluid in the channels 170 or 172 is required to achieve tangent flow into the vortex chamber 140. Additionally, this direct flow path reduces erosive effects of the device surface.

In accordance with the present invention, some fluid flow from the vortex chamber 140 is used to shift the fluid from the nozzle 152 from one side of the jet chamber 154 to the other. For this purpose, the flow path 120 preferably includes a feedback control circuit, designated herein generally by the reference numeral 176. In its preferred form, the feedback control circuit 176 includes first and second feedback channels 178 and 180 that conduct fluid to control ports in the jet chamber 154, as described in more detail below. The first feedback channel 178 extends from a first feedback outlet 182 at the periphery of the vortex chamber 140. The second feedback channel 180 extends from a second feedback outlet 184 also at the periphery of the vortex chamber 140.

The first and second feedback outlets 182 and 184 are positioned to direct fluid in opposite, tangential paths out of the vortex chamber 140. Thus, when fluid is moving in a clockwise vortex CW, some of the fluid will tend to exit through the second feedback outlet 184 into the second feedback channel 180. Likewise, when fluid is moving in a counter-clockwise vortex CCW, some of the fluid will tend to exit through the first feedback outlet 182 into the first feedback channel 178.

With continuing reference to FIG. 4, the first feedback channel 178 connects the first feedback outlet 182 to a first control port 186 in the jet chamber 154, and the second feedback channel 180 connects the second feedback outlet 184 to a second control port 188. Although each feedback channel could be isolated or separate from the other, in this preferred embodiment of the flow path, the feedback channels 178 and 180 share a common curved section 190 through which fluid flows bidirectionally.

The first feedback channel 178 has a separate straight section **178*a* that connects the first feedback outlet 182 to the curved section 190 and a short connecting section 178*b* that connects the common curved section 190 to the control port 186, forming a generally J-shaped path. Similarly, the second feedback channel 180 has a separate straight section 180*a* that connects the second feedback outlet 184 to the common curved section 190 and a short connection section 180*b* that connects the common curved section 190 to the second control port 188**.

The curved section 190 of the feedback circuit 176 together with the connecting sections **178*b* and 180*b* form an oval return loop extending between the first and second control ports 186 and 188. Alternately, two separate curved sections could be used, but the common bidirectional segment 190 promotes compactness of the overall design. It will also be noted that the diameter of the return loop approximates that of the vortex chamber 140. This allows the feedback channels 178 and 180** to be straight, which facilitates flow therethrough. However, these dimensions may be varied.

As seen in FIG. 4, in this configuration of the feedback control circuit 176, the ends of the straight sections 178*a* and 180*a* of the first and second feedback channels 178 and 180 join the return loop at the junctions of the common curved section 190 and each of the connecting sections 178*b* and 180*b*. It may prove advantageous to include a jet 196 and 198 at each of these locations as this will accelerate fluid flow as it enters the curved section 190.

It will be understood that the size, shape, and location of the various openings and channels may vary. However, the configuration depicted in FIG. 4 is particularly advantageous. The first and second inlet openings 170 and 172 may be within about 60-90 degrees of each other. Additionally, the first inlet opening 170 is adjacent the first feedback outlet 182, and the second inlet opening 172 is adjacent the second feedback outlet 184. Even more preferably, the first and second inlet openings 170 and 172 and the first and second feedback outlets 182 and 184 all are within about a 180 degree segment of the peripheral wall of the vortex chamber 140.

Now it will be apparent that fluid flowing into the vortex chamber 140 from the first input channel 156 will form a clockwise CW vortex and as the vortex peaks in intensity, some of the fluid will shear off at the periphery of the chamber out of the second feedback outlet 184 into the second feedback channel 180, where it will pass through the curved section 190 and into the second control port 188. This intersecting jet of fluid will cause the fluid exiting the nozzle 152 to shift to the other side of the jet chamber 154 and begin adhering to the opposite side. This causes the fluid to flow up the second input channel 158 entering the vortex chamber 140 in the opposite, tangential direction forming a counter-clockwise CCW vortex.

As this vortex builds, some fluid will begin shearing off at the periphery through the first feedback outlet 182 and into the first feedback channel 178. As the fluid passes through the straight section 178*a* and around the curved section 190, it will enter the jet chamber 154 through the first control port 186 into the jet chamber, switching the flow to the opposite wall, that is, from the second input channel 158 back to the first input channel 156. This process repeats as long as an adequate flow rate is maintained.

Figure 5:
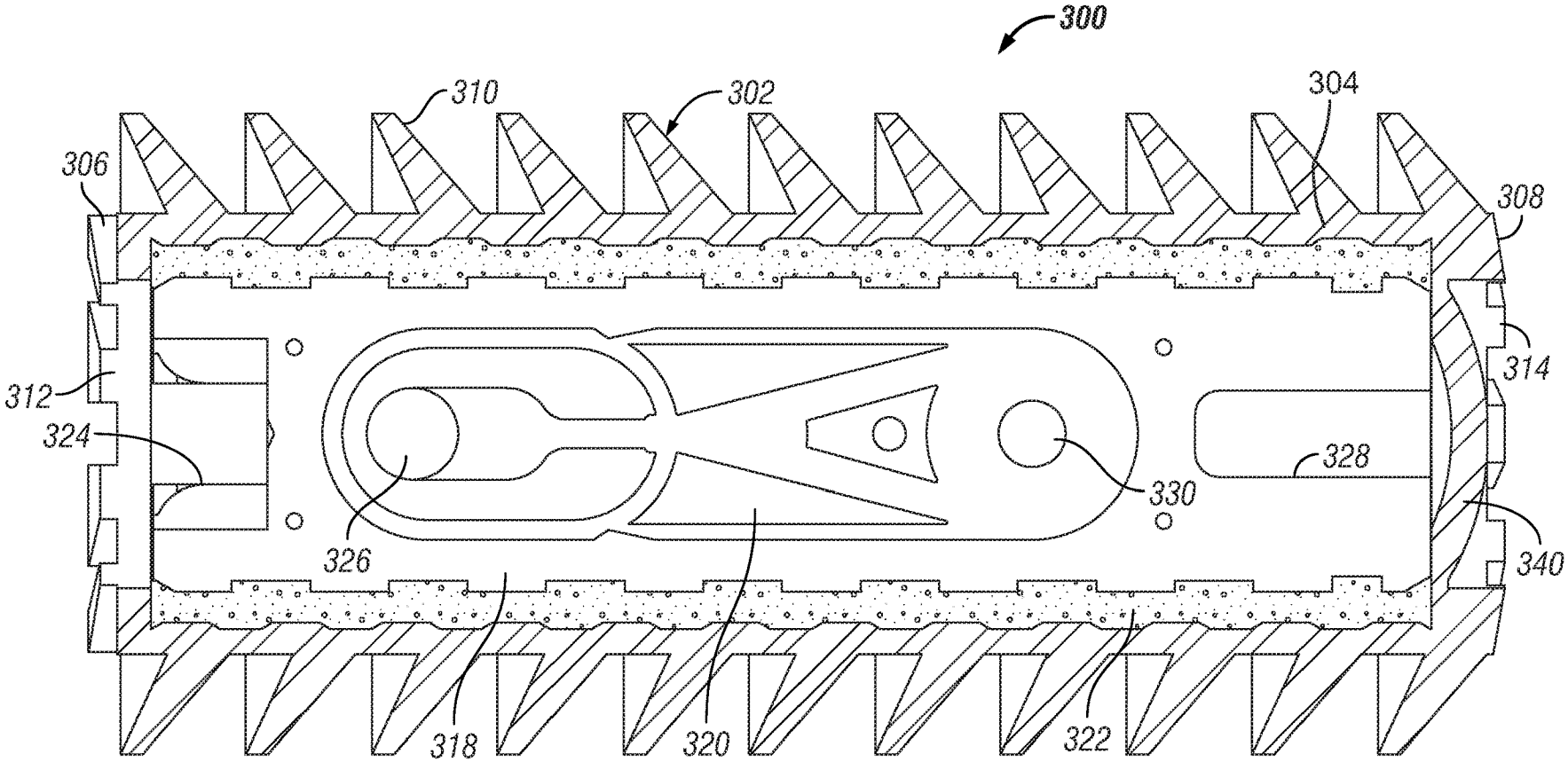
FIG. 5 is a longitudinal sectional view of a casing plug comprising a variable flow resistance device in accordance with a preferred embodiment of the present invention.
Figure 6:
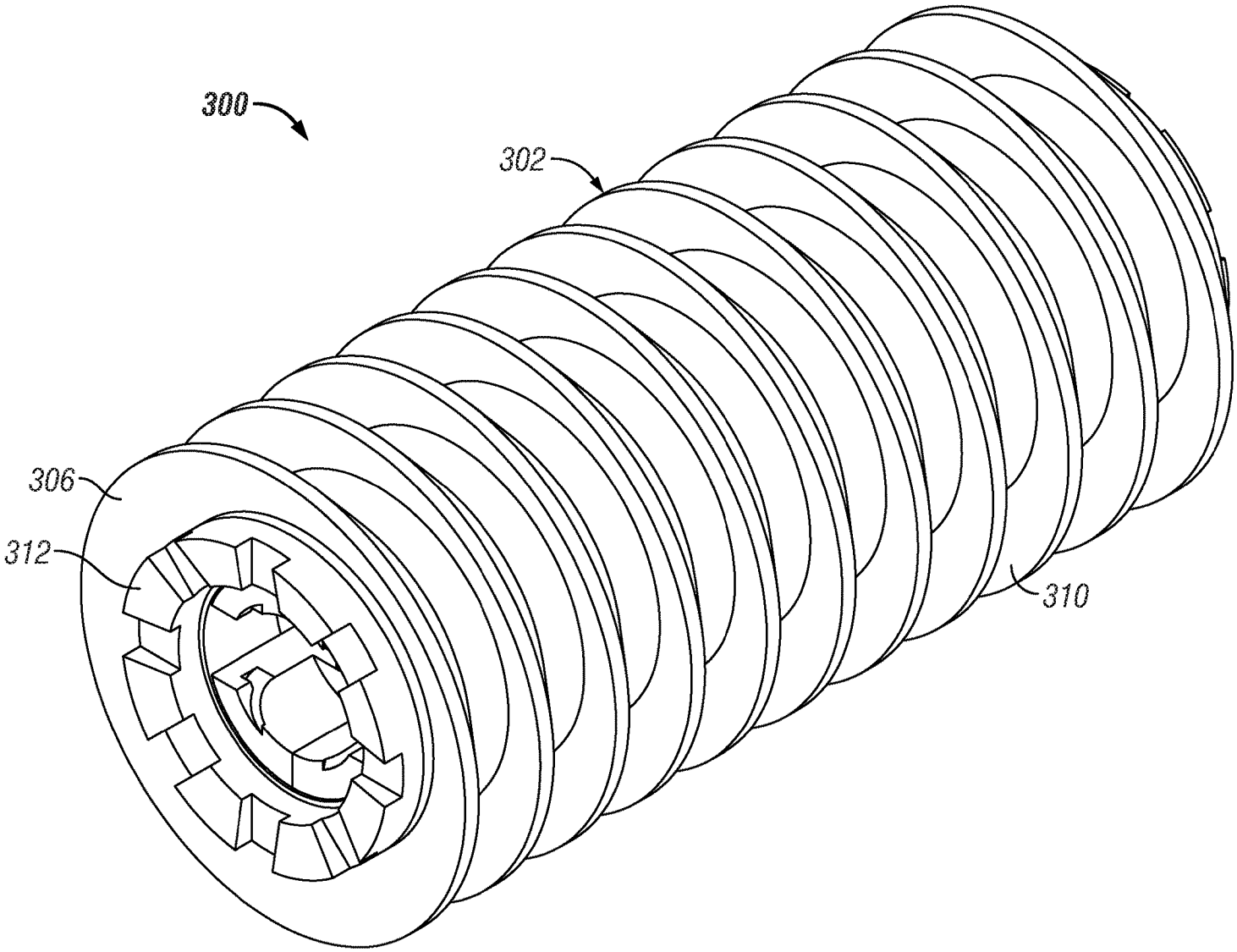
FIG. 6 is a perspective view taken from the uphole or trailing end of the casing plug shown in FIG. 4.
Figure 7:
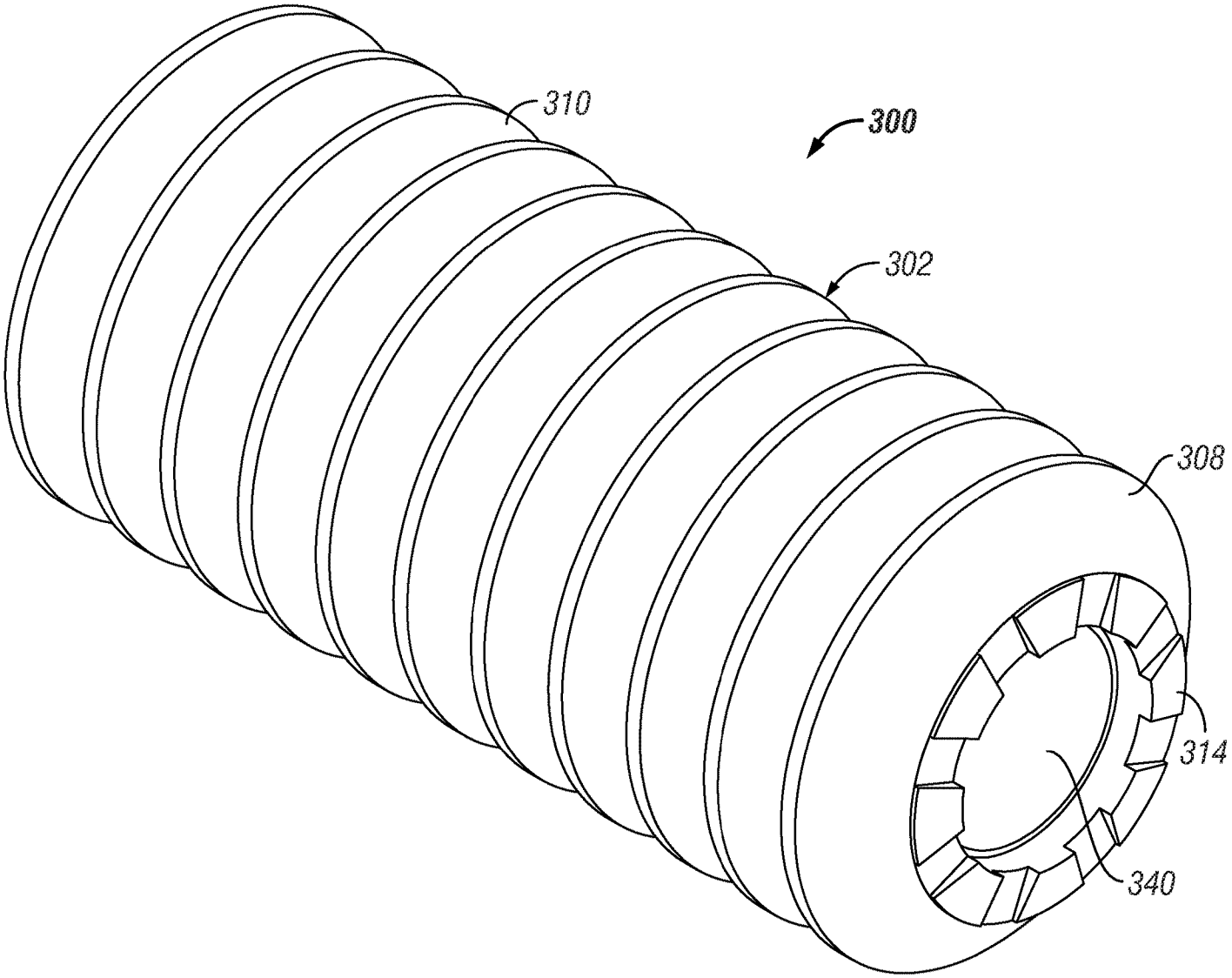
FIG. 7 is a perspective view taken from the downhole or leading end of the casing plug shown in FIG. 4.

With reference now to FIGS. 5-7, another embodiment of the vibrating tool will be described. The vibrating tool 300 shown in these Figures and designated generally by the reference number 300 is a casing plug. As such, it can be pumped down the casing string assembly and "landed" at a target location to become a component of the casing string assembly.

As best seen in FIG. 5, the casing plug 300 comprises a housing 302 with a body section 304 having uphole and downhole ends 306 and 308. The housing preferably is formed with circumferential wipers 310 and is made of rubber.

The term "wiper" is used broadly herein to refer to a resilient annular cup or cone-shaped sealing element that is fixed to the exterior of the housing and that is sized to extend to the inside surface of the wellbore to form a sliding seal with the wellbore. When lowered or pumped into the well, the wiper seals against the wellbore wall and removes well fluids and solids that adhere to the inside of the wellbore. A "wiper plug" style seal typically includes multiple cup elements fixed on the outer diameter of the housing. Another type of wiper is a so-called "swab cup," which may be a single cup-shaped resilient element, and often is slidably mounted on the housing. The swab cup type wiper also may include a reinforcing shoe or base member. These and other types of structures are within the scope of the term "wiper" as used herein.

As best seen in FIGS. 6 and 7, the uphole and downhole ends 306 and 308 are provided with teeth 312 and 314. These teeth engage the landing surface to prevent rotation of the plug with a drill bit when the plug is later drilled out of the casing string.

As seen best in FIG. 5, an insert 318 defining a flow path 320 is secured inside the housing body 304 using cement 322. Alternately, the housing 302 may be molded directly on the preformed insert 318.

The insert 318 includes an insert inlet 324 continuous with the uphole end 306 of the plug 300. The insert inlet 324 directs fluid to enter the flow path inlet 326. The insert 318 includes an insert outlet 328 that receives fluid leaving the flow path 320 through the flow path outlet 330. A frangible rupture disc 340 in the downhole end 308 is ruptured after landing to establish flow through the casing string.

Figure 8:
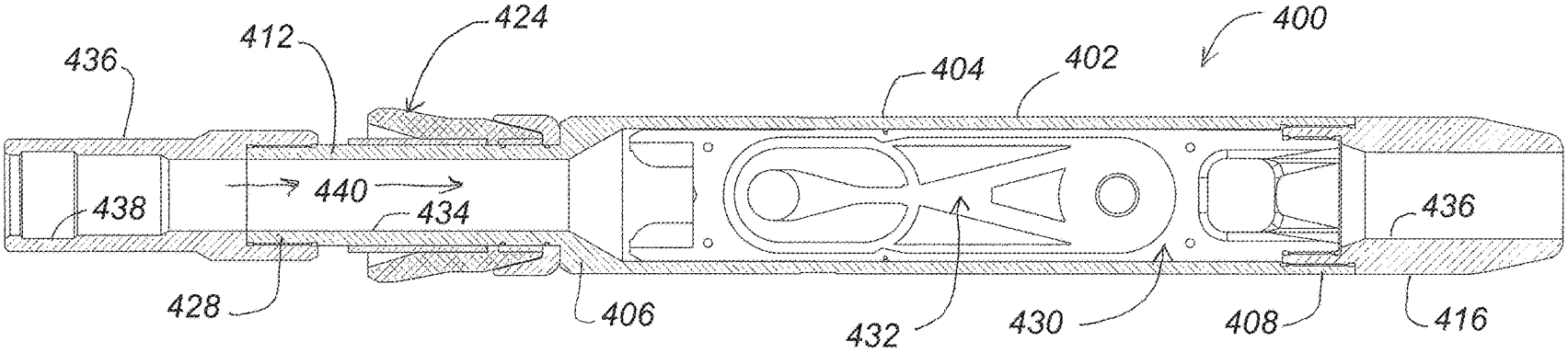
FIG. 8 is longitudinal sectional view of a pumpable retrievable casing plug comprising a variable flow resistance device in accordance with another preferred embodiment of the present invention.
Figure 8A:
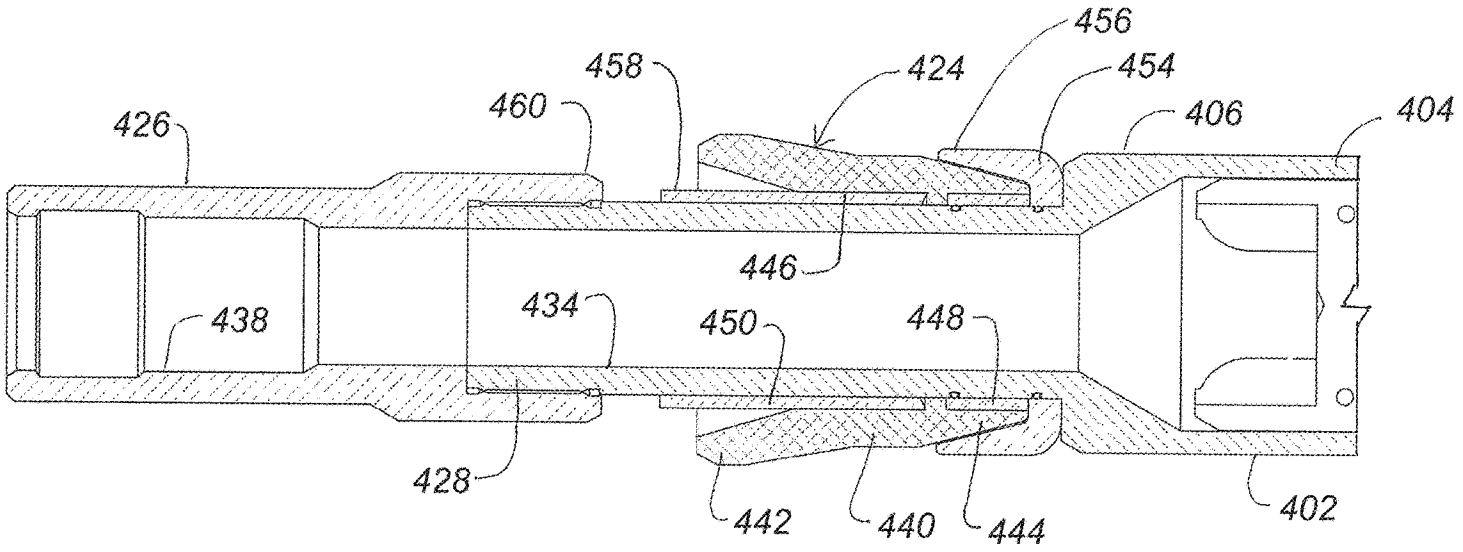
FIGS. 8A-8B show the casing plug of FIG. 8 in enlarged, sequential sections.
Figure 8B:
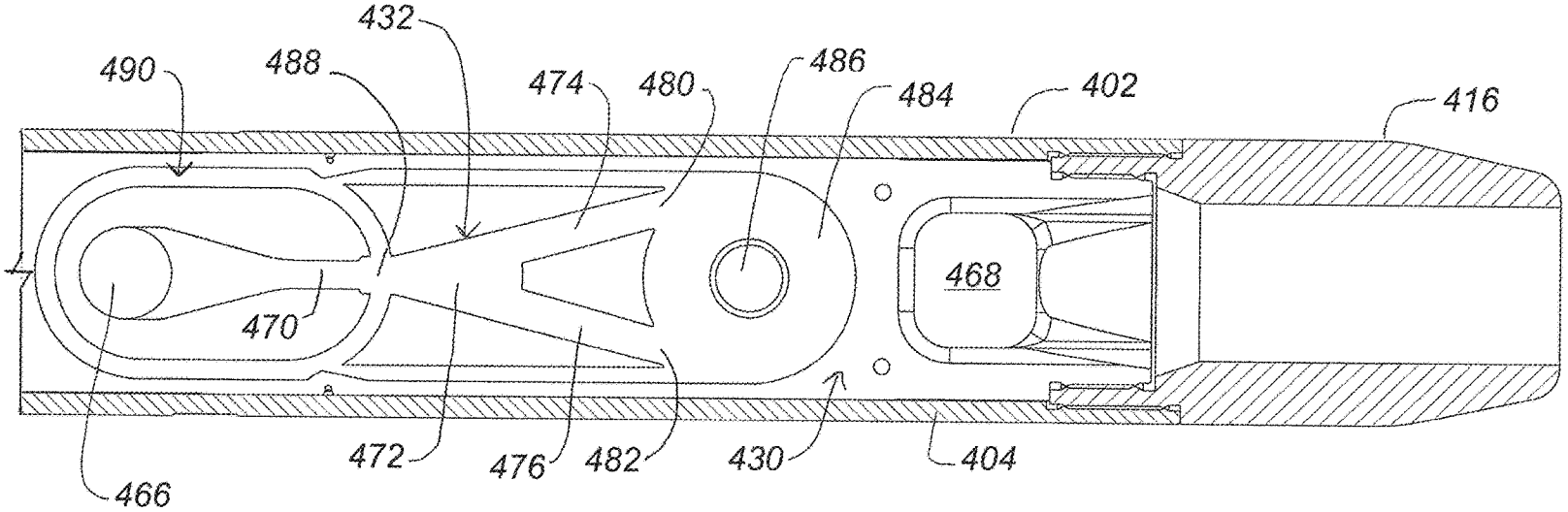

With reference now to FIGS. 8 and 8A-8B, another embodiment of the vibrating tool will be described. In this embodiment, the vibratory tool is a pumpable casing plug designated generally by the reference number 400.

As best seen in FIG. 8, the casing plug 400 comprises a tubular housing 402 with a body section 404 having a first uphole end 406 and a second downhole end 408. Although the structure of the body section 404 may vary, it may be a solid tubular member as shown in FIG. 8. A first end section is attached to the uphole end 406 of the body section 404. In this embodiment, the first end section is an elongate tubular neck 412 extending from the uphole end 406 of the body section 404.

A second end section is attached to the downhole end 408 of the body section 404. In the exemplary embodiment of FIG. 8, the second end section is a tubular nose cone 416. The nose cone 416 may be attached by a threaded connection or by any other suitable means. A rupture disk (not shown) may be interposed between the nose cone 416 and the downhole end 408 of the body section 404 of the housing 402.

At least a first wiper is supported on one of the first and second end sections of the housing 402. By way of example, in this embodiment, a wiper may be supported on the neck 412 while the nose cone 416 is wiper free. Still further, the body section 404 is free of wipers for a reason explained below. As illustrated, the wiper may be a swab cup assembly 424 described in more detail hereafter.

A fishing neck 426 may be attached to the uphole end 428 of the first end section 412 so that the plug 400 may be retrieved with conventional fishing and retrieval tools and methods. The style and structure of the fishing neck 426 may vary. In the illustrative embodiment of FIGS. 8, 8A, & 8B, the fishing neck 426 is a conventional GS profile internal fishing neck, but this is not limiting.

With continuing reference to FIG. 8, the body section 404 of the housing contains a vibratory insert 430 that defines a flow path 432 configured, in response to fluid flow therethrough, to generate variable flow resistance as described above in reference to the embodiments of FIGS. 2, 3, & 5. The insert is sized to be received in the body section 404 of the housing 402. The bore 434 of the tubular neck 412, the bore 436 of the nose cone 416, and the bore 438 of the fishing section 426, if one is employed, together with the flow path 432 formed in the insert 430 form a throughbore 440 extending the length of the casing plug 400 so that well fluids can be pumped through the plug once the rupture disk 426 is perforated.

Turning now to FIGS. 8A and 8B, the vibratory plug 400 will be described further. The swab cup assembly 424 may comprise an elongate cup 440 with a flared open end 442 and a base 444. The bore 446 of the cup 444 at the base is molded to a base sleeve 448, and the midportion of the cup 440 is molded to a longer cup sleeve 450. A shoe 454 captures the base 444 of the cup 440 between the base sleeve 448 and flange 456 of the shoe.

The cup 440, base sleeve 448, cup sleeve 450, and shoe 454 all are secured together so that they move as a unit. The bores of the base sleeve 448, cup sleeve 450, and shoe 454 are sized to move slidably a distance on the outer diameter of the neck 412. The cup sleeve 450 is sized so that when assembled on the neck 412, there is distance between the uphole end 458 of the cup sleeve and the downhole end 460 of the fishing neck 426. In this way, the downhole end 460 of the fishing neck 426 limits the travel of the swab cup assembly 424 on the neck 412. In use, when the plug 400 is positioned in the well, the cup 440 will flare outwardly to engage the inner wall of the wellbore thereby forming a seal for so long as the fluid pressure is maintained.

As indicated, the flow path 432 may be similar to the flow path previously described. The insert 430 defines inlet 464 (FIG. 8A) and an outlet 468 (FIG. 8B). The insert inlet 464 leads to flow path inlet 466. A nozzle 470 directs fluid from the inlet 466 into a jet chamber 472. First and second input channels 474 and 476 diverge from the jet chamber 472 and connect to first and second inlet openings 480 and 482, respectively, of a vortex chamber 484 with a vortex outlet 486 that is continuous with the insert outlet 468. A feedback-operated switch 488 directs fluid from the flow path inlet 466 alternately to the first and second input channels 474 and 476. A feedback control circuit designated generally at 490 is configured to receive fluid alternately from alternating vortices in the vortex chamber and in response thereto to operate the switch 488. Although the specific configuration of the flow path may vary, in one embodiment the first and second input channels 474 and 476 and the first and second inlet openings 480 and 482 of the vortex chamber 484 are configured to direct fluid in opposite, tangential paths into the vortex chamber. This will produce vortices that are opposite in direction and of equal strength.

Directing attention now to FIG. 9, yet another embodiment of the vibratory plug will be described. The plug, designated generally by the reference number 500, comprises a tubular housing 502 with a body section 504 having a first uphole end 506 and a second downhole end 508. A first end section extends from the uphole end 506 of the body section 504, and a second end section extends from the downhole end 508 of the body section. In this embodiment, each of the first end section and second end section comprises an elongate tubular neck 510 and 512.

At least a first wiper is supported on one of the first and second end sections of the housing 502. Preferably, as exemplified by this embodiment, a first wiper assembly 516 is supported on the neck 510, and a second wiper assembly 518 is supported on the neck 512. The body section 504 is free of wipers for a reason explained below. The wiper assemblies 516 and 518 may be "wiper plug" style wipers described in more detail hereafter.

Figure 9:
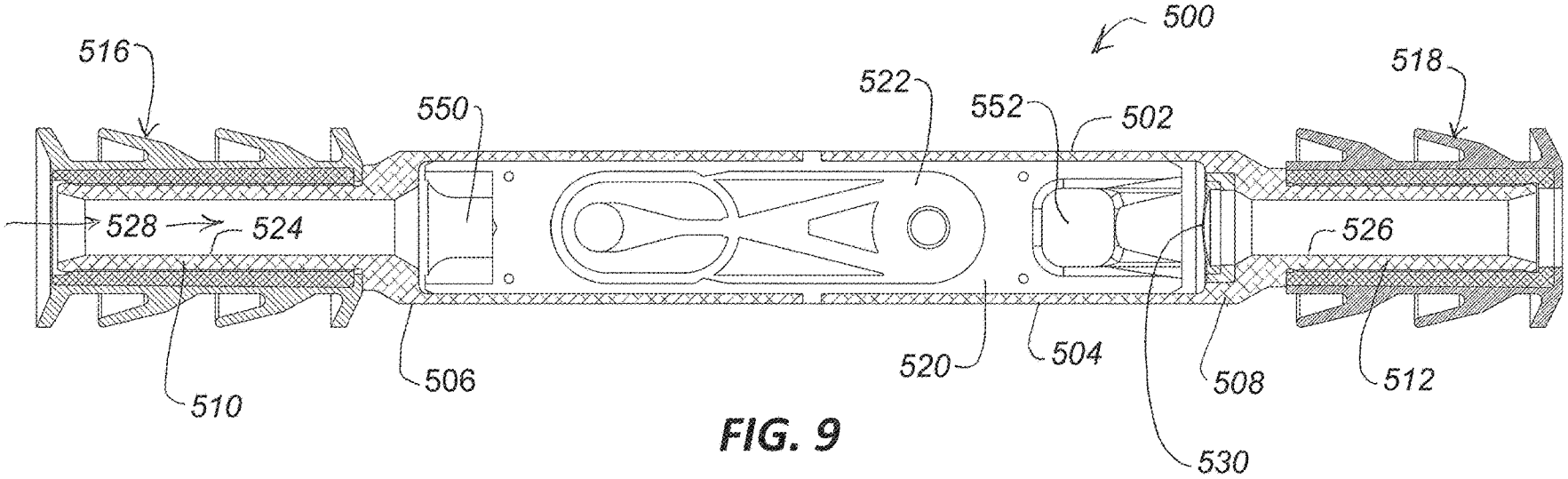
FIG. 9 is longitudinal sectional view of a pumpable drillable casing plug comprising a variable flow resistance device in accordance with another preferred embodiment of the present invention.

With continuing reference to FIG. 9, the body section 504 of the housing contains a vibratory insert 520 that defines a flow path 522 configured, in response to fluid flow therethrough, to generate variable flow resistance. The insert 520 is sized to be received in the body section 504 of the housing 502. The bore 524 of the tubular neck 510, the bore 526 of the tubular neck 512, together with the flow path 522 formed in the insert 520 form a throughbore 528 extending the length of the casing plug 500 so that well fluids can be pumped through the plug 500. A rupture disk 530 may be interposed between the tubular neck 512 and the downhole end of the insert 522 in the body section 504 of the housing 502.

Figure 9A:
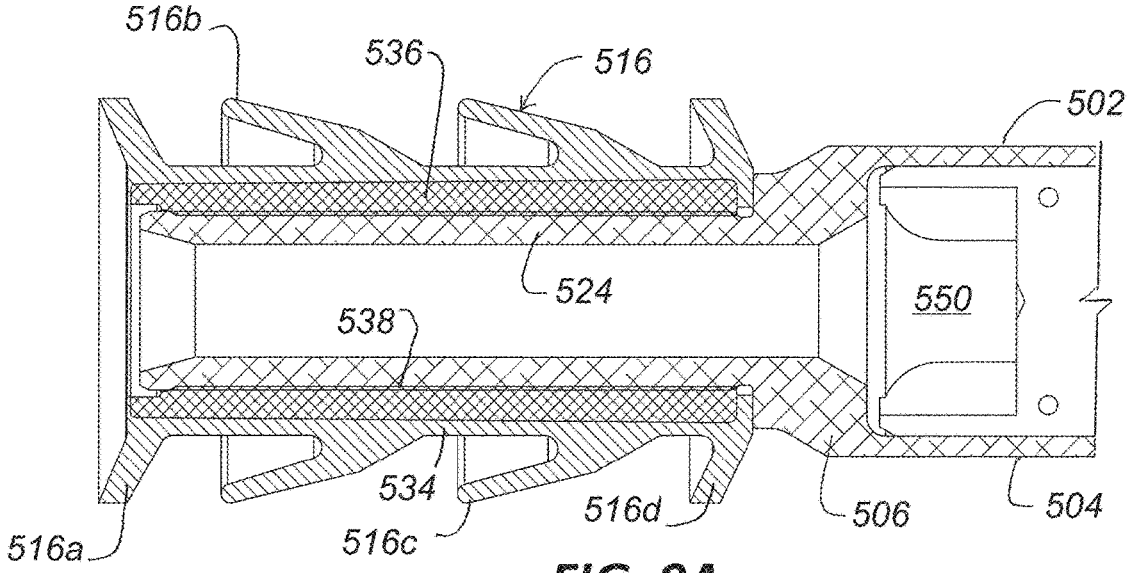
FIGS. 9A-9C show the casing plug of FIG. 9 in enlarged, sequential sections.
Figure 9B:
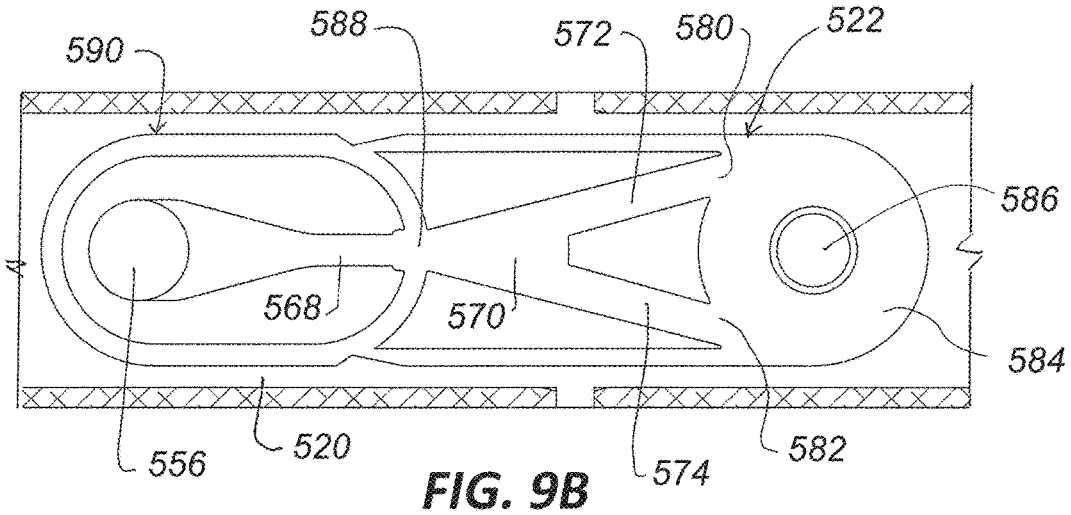
Figure 9C:
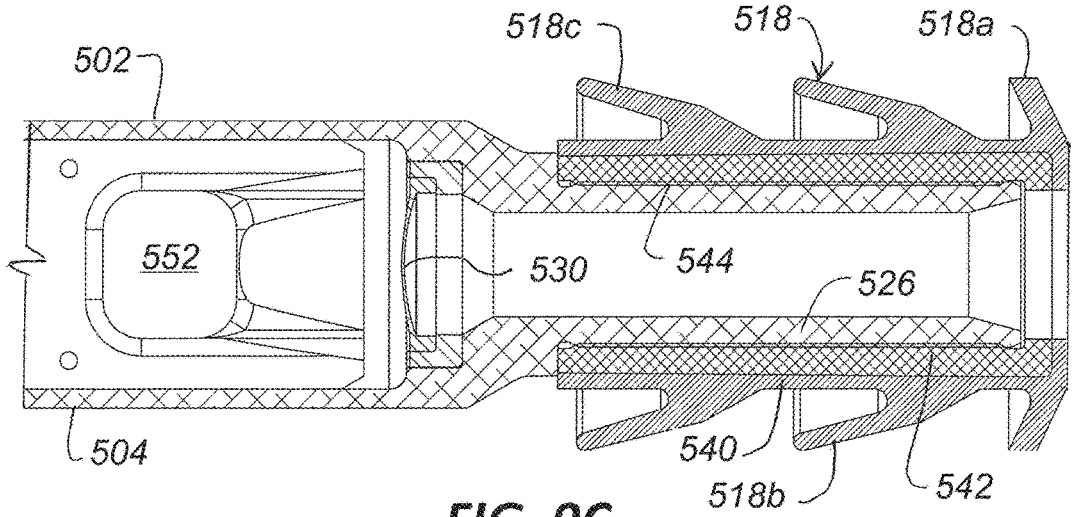

Turning now to FIGS. 9A-9C, the vibratory plug 500 will be described further. The wiper assembly 516, as seen in FIG. 9A, may comprise one or more flexible cups and preferably comprises a plurality of grouped cups. Most preferably, the wiper assembly 516 comprises four wiper cups 516*a*, 516*b*, 516*c*, and 516*d*. These cups 516*a*, 516*b*, 516*c*, and 516*d* may be integrally formed of elastomeric material as by molding or any other suitable process so that they extend from a common tubular body portion 534. The wiper cups 516*a*, 516*b*, 516*c*, and 516*d* and the body portion 534 may be molded onto a tubular member, such as an aluminum sleeve 536. The sleeve 536 is mounted on the tubular neck 524 in a suitable manner. Preferably, the wiper assembly 516 is non-movably mounted to the tubular neck 534 such as by threads at 538.

The wiper assembly 518, as seen in FIG. 9C, may comprise one or more flexible cups and preferably comprises a plurality of grouped cups. Most preferably, the wiper assembly 518 comprises three wiper cups 518*a*, 518*b*, and 518*c*. These cups 518*a*, 518*b*, and 518*c* may be integrally formed of elastomeric material as by molding or any other suitable process so that they extend from a common tubular body portion 540. The wiper cups 518*a*, 518*b*, and 518*c* and the body portion 540 may be molded onto a tubular member, such as an aluminum sleeve 542. The sleeve 542 is mounted on the tubular neck 526 in a suitable manner. Preferably, the wiper assembly 518 is non-movably mounted to the tubular neck 526 such as by threads at 544. In use, when the plug 500 is pumped down the well, the flexible wiper cups will yield and pass over obstacles in the wellbore. Once positioned, the wiper cups will bulge outwardly to sealingly engage the inner wall of the wellbore for so long as the fluid pressure is maintained.

The flow path 522 is shown in FIG. 9B to which attention now is directed. The flow path 522 may be similar to the flow paths previously described. The insert 520 defines inlet 550 (FIG. 9A) and an outlet 552 (FIG. 9C). The insert inlet 550 leads to flow path inlet 566. A nozzle 568 directs fluid from the inlet 556 into a jet chamber 570. First and second input channels 572 and 574 diverge from the jet chamber 570 and connect to first and second inlet openings 580 and 582, respectively, of a vortex chamber 584 with a vortex outlet 586 that is continuous with the insert outlet 552. A feedback-operated switch 588 directs fluid from the flow path inlet 556 alternately to the first and second input channels 572 and 574. A feedback control circuit designated generally at 590 is configured to receive fluid alternately from alternating vortices in the vortex chamber and in response thereto to operate the switch 588. Although the specific configuration of the flow path may vary, in one embodiment the first and second input channels 572 and 574 and the first and second inlet openings 580 and 582 of the vortex chamber 584 are configured to direct fluid in opposite, tangential paths into the vortex chamber. This will produce vortices that are opposite in direction and of equal strength.

Figure 10:
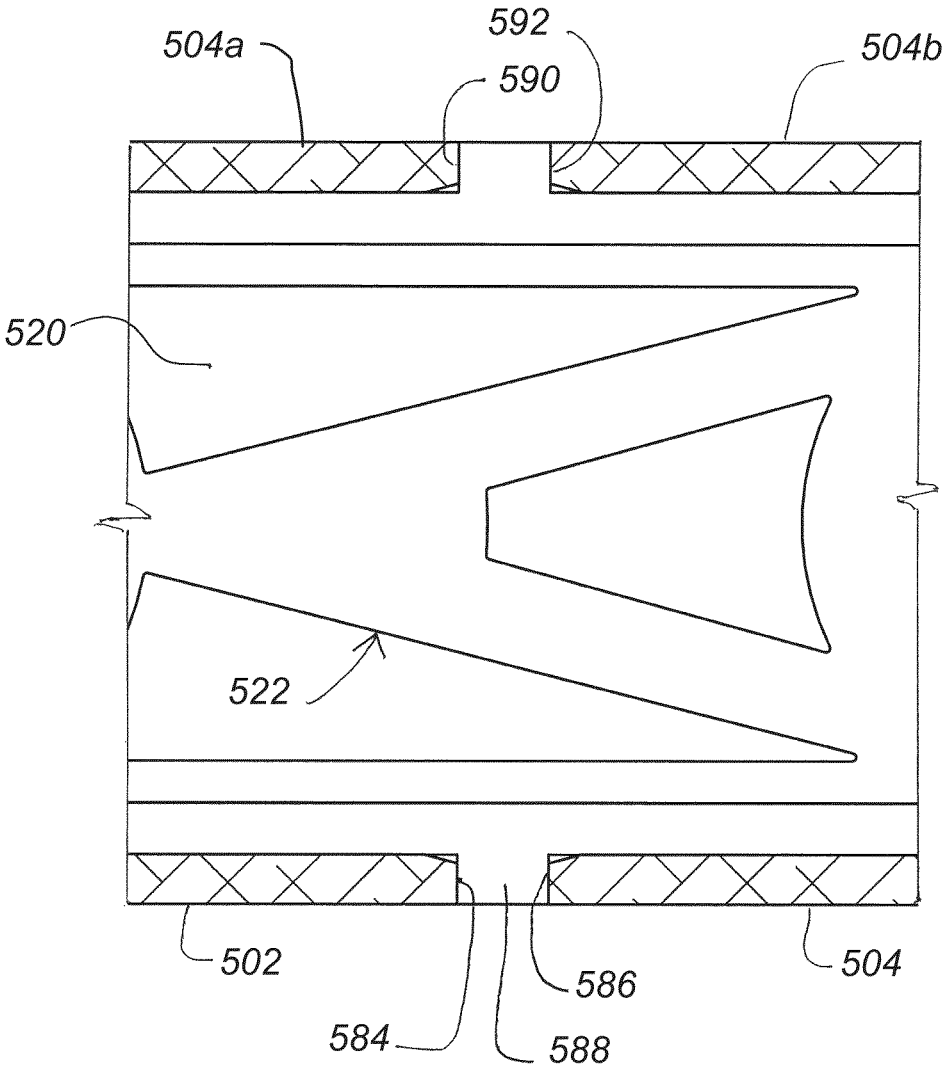
FIG. 10 is an enlarged, fragmented, sectional view of the center of the plug shown in FIG. 9 illustrating the two-part housing that may be employed in a drillable embodiment of the tool.

Turning now to FIG. 10, another advantageous feature of the plug 500 will be described. The various components of the plug 500 may be formed of material that permits the plug to be drilled out when necessary. For example, the components may be formed of drillable aluminum with a hardened surface coating. The body section 504 of the housing 502 may be split or divided transversely into first and second segments 504*a* and 504*b*, each having axially and oppositely facing end faces 584 and 586.

A circumferential rib 588 is formed on the outer diameter of the insert 520, and the rib has first and second axially-facing upward and downward shoulders 590 and 592. As illustrated, the axially-facing end faces 584 and 586 of the first and second housing segments 504*a* and 504*b* engage the first and second axially-facing upward and downward shoulders 590 and 592 of the circumferential rib 588 on the insert 520. The first and second segments 504*a* and 504*b* of the body section 504 of the housing 502 are sized to engage the outer diameter of the insert 520 in an interference fit and to provide a constant and uninterrupted outer diameter along the length of the housing.

The split housing 502 of the plug 500 simplifies assembly. And, since the plug 500 of this embodiment is designed to be removed by drilling through it, there is no need for a construction that allows repair or redressing the tool. In other embodiments, the housing segments 504*a* and 504*b* may be threadedly attached to the insert 520.

As mentioned previously, in each of the above-described plugs 400 and 500, the the section of the housing that encloses the insert is free of wipers. This allows the housing and more importantly the insert to have a greater diameter than is possible where wipers are included along this section of the housing. This, in turn, allows the flow path to be sized for higher flow rates so that the vibratory action of the tool can be optimized.

Having described the various vibrating casing tools of the present invention, the inventive method now will be explained. In accordance with the method of the present invention, a wellbore is finished. As indicated previously, "finished" or "finishing" refers to the process of casing a wellbore, cementing a casing string, or both. Where the wellbore is to be cased and then cemented, the wellbore may be finished in a single operation in monobore applications, or in multiple operations in tapered casing applications.

After the wellbore is drilled, or after a first segment of wellbore is drilled, a first casing string assembly is deployed in the well. The first casing string assembly comprises at least one vibrating tool. The vibrating tool may be any of several commercially available vibrating tools that comprise a variable flow resistance device. One such tool is the Achiever brand tool available from Thru Tubing Solutions, Inc. (Oklahoma City, Okla.) Another is the Agitator Brand tool made by National Oilwell Varco (Houston, Tex.). However, in the most preferred practice of the method of the present invention, the vibrating tools used in the casing string assembly will be those made in accordance with one or more of the above-described embodiments. In addition to the vibrating tools, the casing string assembly likely will also include float equipment, such as a float shoe or a float collar or both.

This first casing string assembly next is advanced to the target location. This is accomplished by pumping fluid through the first casing string assembly at a rate sufficient to cause the vibrating tool to vibrate the casing string assembly while the casing string assembly is being advanced. The type of fluid may vary, so long as the fluid can be pumped at a rate to activate the vibrating tool or tools in the casing string assembly. The fluid may be a circulating fluid (not cement), such as drilling mud, brine, or water. The fluid pumping may be continuous or intermittent. This process is continued until the first casing string reaches the target location.

In some cases, after deploying the casing string, additional vibratory action in the casing string may be desired. In some instances, the vibrating tool may indicate wear. Wear or damage to the vibrating tool of this invention may be indicated by a change in overall circulating pressure, which indicates a change in pressure drop at the tool. This, in turn, suggests that the tool is worn or damaged. Additionally, in some cases, a noticeable decrease in vibration of the casing string at the surface suggests decreasing function of the vibrating tool downhole. Still further, increasing difficulty in advancing the casing may reveal a worn or damaged vibrating tool.

In these cases, where additional vibratory action is desired or the deployed tools are evidencing wear or damage, additional vibrating tools may be added to the casing string assembly by deploying one or more casing plugs, also described above. After one or more vibrating casing plugs of the present invention have been deployed and landed in the casing string, advancement of the casing string assembly is resumed while maintaining fluid flow. This may be repeated as necessary until the target location is reached.

Once the first casing string has been advanced to the target location, the annulus may be cemented. This may be carried out in the conventional manner using top and bottom cementing plugs to create an isolated column of cement. The cement/fluid column created is pumped to force the cement into the annulus. Again, this pumping action continues to activate the one or more vibrating tools in the first casing string assembly, and this vibrating facilitates the distribution of the cement through the annular void. Once the cement is properly distributed, operations are paused and maintained under pressure until the cement sets. At this point, the vibrating tools in the first casing string, as well as any float equipment, can be drilled out of the cemented casing. In the case of tapered casing applications, after the first casing string is drilled out, the wellbore may be extended and second and subsequent casing string assemblies may be installed using the same procedures.

The following patent applications contain subject matter related to this application: application Ser. No. 13/455,554, filed Apr. 25, 2012, entitled Methods and Devices for Casing and Cementing Wellbores, now U.S. Pat. No. 8,424,605, issued Apr. 23, 2013; Application Ser. No. 13/427,141 entitled "Vortex Controlled Variable Flow Resistance Device and Related Tools and Methods," filed Mar. 22, 2012, now U.S. Pat. No. 8,453,745, issued Jun. 4, 2013; and, application Ser. No. 14/823,625, entitled "Vortex Controlled Variable Flow Resistance Device and Related Tools and Methods," filed Aug. 11, 2015, now U.S. Pat. No. 9,316,065, issued Apr. 19, 2016. The contents of these prior applications are incorporated herein by reference.

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts within the principles of the inventions to the full extent indicated by the broad meaning of the terms. The description and drawings of the specific embodiments herein do not point out what an infringement of this patent would be, but rather provide an example of how to use and make the invention.

What is claimed is:

1. A pumpable casing plug for use in a wellbore with well fluids, the casing plug comprising:

a housing comprising a body section, a first end section, and a second end section;

wherein the first end section of the housing is the uphole end;

wherein the housing is configured to be pumped through the wellbore in the well fluids;

an insert defining a flow path configured, in response to fluid flow therethrough, to generate variable flow resistance to generate cyclic hydraulic loading in the well, thereby causing repeated extension and contraction of the casing string sufficient to reduce the drag force on the casing string thereby facilitating advancement of the casing string down the wellbore, wherein the insert is sized to be received in the body section of the housing;

wherein the housing and the flow path in the insert together form a throughbore so that well fluids can be pumped through the casing plug;

a tubular fishing neck connected to the first end section; and at least a first wiper supported on the first end section of the housing;

wherein the body section of the housing is free of wipers.

2. The pumpable casing plug of claim 1 wherein the second end section of the housing is the downhole end and wherein the casing plug further comprises a tubular nose cone connected to the second end section.

3. The pumpable casing plug of claim 2 wherein the nose cone is wiper-free.

4. The pumpable casing plug of claim 1 wherein the flow path comprises:

an inlet and an outlet;

a jet chamber;

a nozzle to direct fluid from the inlet into the jet chamber;

first and second input channels diverging from the jet chamber;

at least one vortex chamber continuous with the outlet and having first and second inlet openings;

wherein the first input channel connects to the first inlet opening and the second input channel connects to the second inlet opening;

a feedback-operated switch to direct fluid from the inlet alternately to the first and second input channels; and a feedback control circuit configured to receive fluid alternately from primary and secondary vortices in the vortex chamber and in response thereto to operate the switch.

5. The pumpable casing plug of claim 4 wherein first and second input channels and the first and second inlet openings of the vortex chamber are configured to direct fluid in opposite, tangential paths into the vortex chamber.

6. The pumpable casing plug of claim 4 wherein the first input channel and the first inlet opening in the at least one vortex chamber are configured to direct fluid flow into the vortex chamber along a tangential path to generate a primary vortex and wherein the second input channel and the second inlet opening of the vortex chamber are configured to direct fluid flow along a radial path into the vortex chamber to produce a secondary vortex that is opposite in direction and weaker in strength relative to the primary vortex.

7. The pumpable casing plug of claim 1 wherein the body section of the housing is a solid tubular member.

8. The pumpable casing plug of claim 1 wherein the body section of the housing is split transversely into first and second segments, wherein the outer diameter of the insert includes a circumferential rib having first and second axially-facing upward and downward shoulders, wherein the first and second segments of the body section of the housing have axially and oppositely facing end faces, wherein the axially-facing end faces of the first and second housing segments engage the first and second axially-facing upward and downward shoulders of the circumferential rib on the insert, and wherein the first and second segments of the body section of the housing are sized to engage the outer diameter of the insert in an interference fit.

9. The pumpable casing plug of claim 1 further comprising a rupture disk supported in the throughbore.

10. The pumpable casing plug of claim 1 wherein the second end section is the downhole end of the housing and wherein a second wiper is supported on the second end section of the housing.

11. The pumpable casing plug of claim 10 wherein the first wiper is nonmovably fixed to the first end section of the housing.

12. The pumpable casing plug of claim 11 wherein the first wiper is one of a first plurality of grouped wipers.

13. The pumpable casing plug of claim 12 wherein the second wiper is one of a second plurality of grouped wipers nonmovably fixed to the second end section of the housing.

14. The pumpable casing plug of claim 10 wherein the body section of the housing is split transversely into first and second segments, wherein the outer diameter of the insert includes a circumferential rib having first and second axially-facing upward and downward shoulders, wherein the first and second segments of the body section of the housing have axially and oppositely facing end faces, wherein the axially-facing end faces of the first and second segments of the body section of the housing are sized to engage the first and second axially-facing upward and downward shoulders of the circumferential rib on the insert, and wherein the first and second segments of the insert section of the housing are secured to the insert.

15. The pumpable casing plug of claim 14 wherein the first and second segments of the body section of the housing are cooperatively sized with the insert to engage the outer diameter of the insert in an interference fit.

16. The pumpable casing plug of claim 10 wherein the casing plug is drillable.

17. A pumpable casing plug for use in a wellbore with well fluids, the casing plug comprising:

a housing comprising a body section, a first end section, and a second end section;

wherein the first end section of the housing is the uphole end and the second end section of the housing is the downhole end;

wherein the housing is configured to be pumped through the wellbore in the well fluids;

an insert defining a flow path configured, in response to fluid flow therethrough, to generate variable flow resistance to generate cyclic hydraulic loading in the well, thereby causing repeated extension and contraction of the casing string sufficient to reduce the drag force on the casing string thereby facilitating advancement of the casing string down the wellbore, wherein the insert is sized to be received in the body section of the housing;

wherein the housing and the flow path in the insert together form a throughbore so that well fluids can be pumped through the casing plug;

a tubular nose-cone connected to the second end section, the nose cone being wiper-free; and at least a first wiper supported on the first end section of the housing;

wherein the body section of the housing is free of wipers.

18. The pumpable casing plug of claim 17 further comprising a tubular fishing neck connected to the first end section.

19. The pumpable casing plug of claim 17 wherein the flow path comprises:

an inlet and an outlet;

a jet chamber;

a nozzle to direct fluid from the inlet into the jet chamber;

first and second input channels diverging from the jet chamber;

at least one vortex chamber continuous with the outlet and having first and second inlet openings;

wherein the first input channel connects to the first inlet opening and the second input channel connects to the second inlet opening;

a feedback-operated switch to direct fluid from the inlet alternately to the first and second input channels; and a feedback control circuit configured to receive fluid alternately from primary and secondary vortices in the vortex chamber and in response thereto to operate the switch.

20. The pumpable casing plug of claim 19 wherein first and second input channels and the first and second inlet openings of the vortex chamber are configured to direct fluid in opposite, tangential paths into the vortex chamber.

21. The pumpable casing plug of claim 19 wherein the first input channel and the first inlet opening in the at least one vortex chamber are configured to direct fluid flow into the vortex chamber along a tangential path to generate a primary vortex and wherein the second input channel and the second inlet opening of the vortex chamber are configured to direct fluid flow along a radial path into the vortex chamber to produce a secondary vortex that is opposite in direction and weaker in strength relative to the primary vortex.

22. The pumpable casing plug of claim 17 wherein the body section of the housing is a solid tubular member.

23. The pumpable casing plug of claim 17 wherein the body section of the housing is split transversely into first and second segments, wherein the outer diameter of the insert includes a circumferential rib having first and second axially-facing upward and downward shoulders, wherein the first and second segments of the body section of the housing have axially and oppositely facing end faces, wherein the axially-facing end faces of the first and second housing segments engage the first and second axially-facing upward and downward shoulders of the circumferential rib on the insert, and wherein the first and second segments of the body section of the housing are sized to engage the outer diameter of the insert in an interference fit.

24. The pumpable casing plug of claim 17 further comprising a rupture disk supported in the throughbore.

25. The pumpable casing plug of claim 17 wherein the first wiper is one of a first plurality of grouped wipers.

26. A pumpable casing plug for use in a wellbore with well fluids, the casing plug comprising:

a housing comprising a body section, a first end section, and a second end section;

wherein the first end section of the housing is the uphole end;

wherein the housing is configured to be pumped through the wellbore in the well fluids;

an insert defining a flow path configured, in response to fluid flow therethrough, to generate variable flow resistance to generate cyclic hydraulic loading in the well, thereby causing repeated extension and contraction of the casing string sufficient to reduce the drag force on the casing string thereby facilitating advancement of the casing string down the wellbore, wherein the insert is sized to be received in the body section of the housing;

wherein the flow path comprises:

an inlet and an outlet;

a jet chamber;

a nozzle to direct fluid from the inlet into the jet chamber;

first and second input channels diverging from the jet chamber;

at least one vortex chamber continuous with the outlet and having first and second inlet openings;

wherein the first input channel connects to the first inlet opening and the second input channel connects to the second inlet opening;

wherein the first input channel and the first inlet opening in the at least one vortex chamber are configured to direct fluid flow into the vortex chamber along a tangential path to generate a primary vortex and wherein the second input channel and the second inlet opening of the vortex chamber are configured to direct fluid flow along a radial path into the vortex chamber to produce a secondary vortex that is opposite in direction and weaker in strength relative to the primary vortex;

a feedback-operated switch to direct fluid from the inlet alternately to the first and second input channels; and a feedback control circuit configured to receive fluid alternately from primary and secondary vortices in the vortex chamber and in response thereto to operate the switch;

wherein the housing and the flow path in the insert together form a throughbore so that well fluids can be pumped through the casing plug; and at least a first wiper supported on the first end section of the housing;

wherein the body section of the housing is free of wipers.

27. The pumpable casing plug of claim 26 further comprising a tubular fishing neck connected to the first end section.

28. The pumpable casing plug of claim 27 wherein the second end section of the housing is the downhole end and wherein the casing plug further comprises a tubular nose cone connected to the second end section.

29. The pumpable casing plug of claim 28 wherein the nose cone is wiper-free.

30. The pumpable casing plug of claim 26 wherein the body section of the housing is a solid tubular member.

31. The pumpable casing plug of claim 26 wherein the body section of the housing is split transversely into first and second segments, wherein the outer diameter of the insert includes a circumferential rib having first and second axially-facing upward and downward shoulders, wherein the first and second segments of the body section of the housing have axially and oppositely facing end faces, wherein the axially-facing end faces of the first and second housing segments engage the first and second axially-facing upward and downward shoulders of the circumferential rib on the insert, and wherein the first and second segments of the body section of the housing are sized to engage the outer diameter of the insert in an interference fit.

32. The pumpable casing plug of claim 26 further comprising a rupture disk supported in the throughbore.

33. The pumpable casing plug of claim 26 wherein the first wiper is one of a first plurality of grouped wipers.

34. The pumpable casing plug of claim 33 further comprising a second plurality of grouped wipers nonmovably fixed to the second end section of the housing.

35. The pumpable casing plug of claim 26 wherein the casing plug is drillable.

* * * * *